US005439180A

United States Patent [19]

Baughman et al.

[11] Patent Number: 5,439,180

[45] Date of Patent: Aug. 8, 1995

[54] READILY INSTALLED UNIVERSAL SEWAGE GRINDER PUMP

[75] Inventors: Thomas R. Baughman, Clifton Park; Clark A. Henry, Scotia; Andrew P. Sleasman, Gansevoort; William R. Schouten, Castleton; Gene A. Rougeux, Boiceville, all of N.Y.

[73] Assignee: Environment/One Corporation, Schenectady, N.Y.

[21] Appl. No.: 60,430

[22] Filed: May 11, 1993

[51] Int. Cl.[6] ..... B02C 18/40

[52] U.S. Cl. ..... 241/36; 241/46.06; 241/185.6; 241/258

[58] Field of Search ..... 241/36, 46.02, 46.06, 241/185.6, 258; 417/38

[56] References Cited

U.S. PATENT DOCUMENTS

| | | | |
|---|---|---|---|
| Re. 28,104 | 8/1974 | Grace . | |
| 2,267,459 | 12/1941 | Hait . | |
| 2,512,764 | 6/1950 | Byram . | |
| 3,664,775 | 5/1972 | Stigberg . | |
| 3,667,692 | 6/1972 | Grace | 241/36 |
| 3,733,449 | 5/1973 | Parker . | |
| 3,857,517 | 12/1974 | Grace et al. . | |
| 3,904,131 | 9/1975 | Farrell, Jr. et al. . | |
| 3,938,744 | 2/1976 | Allen . | |
| 3,987,600 | 8/1976 | Burkholder | 4/10 |
| 3,999,890 | 12/1976 | Niedermeyer . | |
| 4,014,475 | 3/1977 | Grace et al. . | |
| 4,339,231 | 7/1982 | Conery et al. . | |
| 4,637,326 | 1/1972 | Dowell . | |
| 4,822,213 | 4/1989 | Grace et al. . | |
| 4,867,871 | 9/1989 | Bowne . | |
| 4,919,343 | 4/1990 | Van Luik, Jr. et al. . | |
| 5,038,817 | 8/1991 | Henry et al. . | |

*Primary Examiner*—John Husar
*Attorney, Agent, or Firm*—Heslin & Rothenberg

[57] ABSTRACT

An integral, readily installed, universal pump assembly has an integral, liquid-tight outer housing for supporting within a single liquid-tight containment vessel an electric motor driven pump, and discharging liquid from a discharge outlet of the pump. The assembly includes at least one normal high and low liquid level sensing control pneumatic pressure operated electric switch supported within the housing for deriving on-off switching control signals for controlling normal on-off operation of the pump. At least one liquid level sensing diving bell is supported on the housing and has at least one lower open end exposed to the liquid in the collection tank for deriving varying pressure pneumatic liquid level indicating signals for application to the pressure operated switch for deriving the on-off control signal. A dynamically operated liquid level safety cutoff valve is provided within the sensing diving bell for cutting off leakage of liquid into the normal on-off control switch upon the liquid level in the sensing diving bell exceeding a predetermined level. A second liquid level sensing diving bell and pressure operated control switch may be added for deriving a high liquid level alarm output signal. The housing contains a single, closed, liquid-tight chamber in which both the pneumatic pressure operated on-off control switch and a high liquid level alarm pressure operated, control switch

34 Claims, 6 Drawing Sheets

READILY INSTALLED UNIVERSAL SEWAGE GRINDER PUMP

BACKGROUND OF THE INVENTION

This invention relates to a sewage grinder pump assembly.

More particularly, the invention relates to an improved sewage grinder pump assembly that readily may be installed in either newly constructed, or previously built, sewage collection tanks designed for use with and without pumps such as progressing cavity or centrifugal pumps with appended grinders. The invention is designed such that installation of the universal sewage grinder pump assembly in such diverse types of collection tanks is greatly facilitated. After completion of any initial preparatory measures required in the removal of old grinder pumps and other outmoded fixtures, and the cleaning of previously used sewage collection tanks, the subsequent installation or removal for repair (as the case may be) of a new universal sewage grinder pump constructed according to the invention can be accomplished readily. With little effort, a serviceman standing on the ground or a basement floor can easily lower or remove the completely preassembled, universal sewage grinder pump assembly into the collection tank. Then only a minimum number of interconnections have to be made for permanently installing, or a minimum number of interconnections have to be released, for removing the new, universal sewage grinder pump assembly. This can be achieved by simply connecting or disconnecting a single combined electric power supply cable and vent, and a pressurized sewage discharge outlet conduit for discharging sewage or other liquid from the collection tank. This is done in a reliable, safe and permanent manner without requiring that the serviceman enter into the collection tank to any great extent or be physically exposed to its contents for an extended period of time.

BACKGROUND PRIOR ART

U.S. Pat. No. 4,822,213—issued Apr. 18, 1989 for a "Narrow Accessway Sewage Collection Tank Assembly, Remote Operated Quick Connect-Disconnect Coupling and System Using the Same" by Richard C. Grace, Jack L. Cooley and Eric F. Cabahug—inventors, assigned to Environment/One Corporation of Schenectady, N.Y., the same assignee to which the present invention is assigned, discloses a narrow-accessway sewage collection tank assembly and system intended for the same end purpose as the present invention, namely safety and ease of installing and replacing or repairing sewage grinder pumps in the collection tanks of a pressure sewer system. The patent 4,822,213 system uses a remotely operated two-part slide coupling for supporting a sewage grinder pump within an enlarged collecting tank installed outside below normal ground level of residences, commercial or industrial buildings, or in the basements of such buildings, for use in the collection and disposal of sewage produced in the building. The narrow accessway collection tank assembly can be installed with minimum cost and impact upon the environment while maintaining proper operating conditions, good scouring of the collection tank bottom and facilitating below ground installation, subsequent maintenance and servicing or replacement of the sewage grinder pump unit from the surface.

The system includes an enlarged collection tank to be planted below ground level near or within a building and connected to suitable gravity drain conduits interconnected between a facility to be serviced and the collection tank for collecting raw sewage. The sewage grinder pump unit physically is supported within the enlarged collection tank for grinding and pumping ground liquid sewage including any entrained solids out through a pressure sewage discharge outlet conduit to a suitable sewage collection or disposal system such as a drain field, a septic tank, a gravity sewer, a pressure sewer piping system, etc. A narrow-access passageway enclosure is physically supported on top of the collection tank and provides access to the sewage grinder pump unit within the interior of the tank. The narrow-access passageway is of sufficient cross-sectional dimension to allow free passage up and down for the sewage grinder pump unit, but is insufficient in cross-section to accommodate passage of human beings or to accommodate a guide rail system of conventional construction.

A two-part, quick connect-disconnect slide coupling is provided for physically supporting the sewage grinder pump unit within the collection tank properly positioned relative to the bottom of the collection tank to assure proper scouring and preventing buildup of solids. The arrangement also allows ready removal as well as installation of the sewage grinder pump unit from the surface by a serviceman using a remotely operated tool to decouple or couple the grinder pump unit via the quick connect-disconnect slide coupling and withdrawing it upwardly through the narrow-access passageway enclosure to the surface for maintenance, repair or replacement.

The U.S. Pat. No. 4,822,213 system requires separately stringing and physically supporting within the collection tank and narrow accessway of separate power supply cable and separate pressure actuated control switch breathers to atmosphere to assure reliable operation of the on-off switch control over prolonged periods of operation. The separate fasteners and interconnected power supply cable and breather tube complicates installation and removal of the sewage grinder pump assembly and increases its cost of installation and operation.

U.S. Pat. No. 4,867,871—issued Sep. 19, 1989 to William C. Bowne for a "Sewage System Discharge Pump Module", similar to U.S. Pat. No. 4,822,213, discloses a system requiring separately installed dry control vault designed to simplify installation, removal and replacement or repair of the sewage grinder pump assembly without requiring that the serviceman crawl into the sewage collection tank to accomplish such installation or removal and suffer its attendant hazards and discomforts. However, the Bowne system requires the separate excavation, preparing and installation of the separate control vault space as well as the sewage collection tank space and greatly increases the cost of the overall installation.

To overcome the problems and shortcomings of these prior art systems, the present invention was devised.

SUMMARY OF INVENTION

The present invention is an integral, readily installed, universal sewage grinder pump assembly. The assembly comprises an integral, liquid-tight outer housing. The housing provides a single liquid-tight containment vessel within which an electric motor driven grinder pump is supported.

A normal high and normal low liquid level sensing and control facility is supported within the integral liquid-tight outer housing for deriving on-off switching electric control signals. The signals control normal on-off operation of the motor driven pump.

A liquid level sensing diving bell is supported on the integral housing. The liquid sensing diving bell has at least one lower open end exposed to the liquid in the collection tank. The sensing diving bell derives liquid level indicating signals for application to the normal high and normal low liquid level sensing and control facility.

A dynamically operable liquid level safety cutoff valve is mounted within the sensing diving bell for cutting off access of liquid fluid to the normal high and normal low liquid level sensing and control facility upon the liquid level in the sensing diving bell exceeding a predetermined level.

BRIEF DESCRIPTION OF DRAWINGS

The above and other objects, features and many of the attendant advantages of this invention will be appreciated more readily as the same becomes better understood from a reading of the following detailed description when considered in connection with the accompanying drawings, wherein like parts in each of the several figures are identified by the same reference characters, and wherein.

DETAILED DESCRIPTION

Overview

Figure 1:
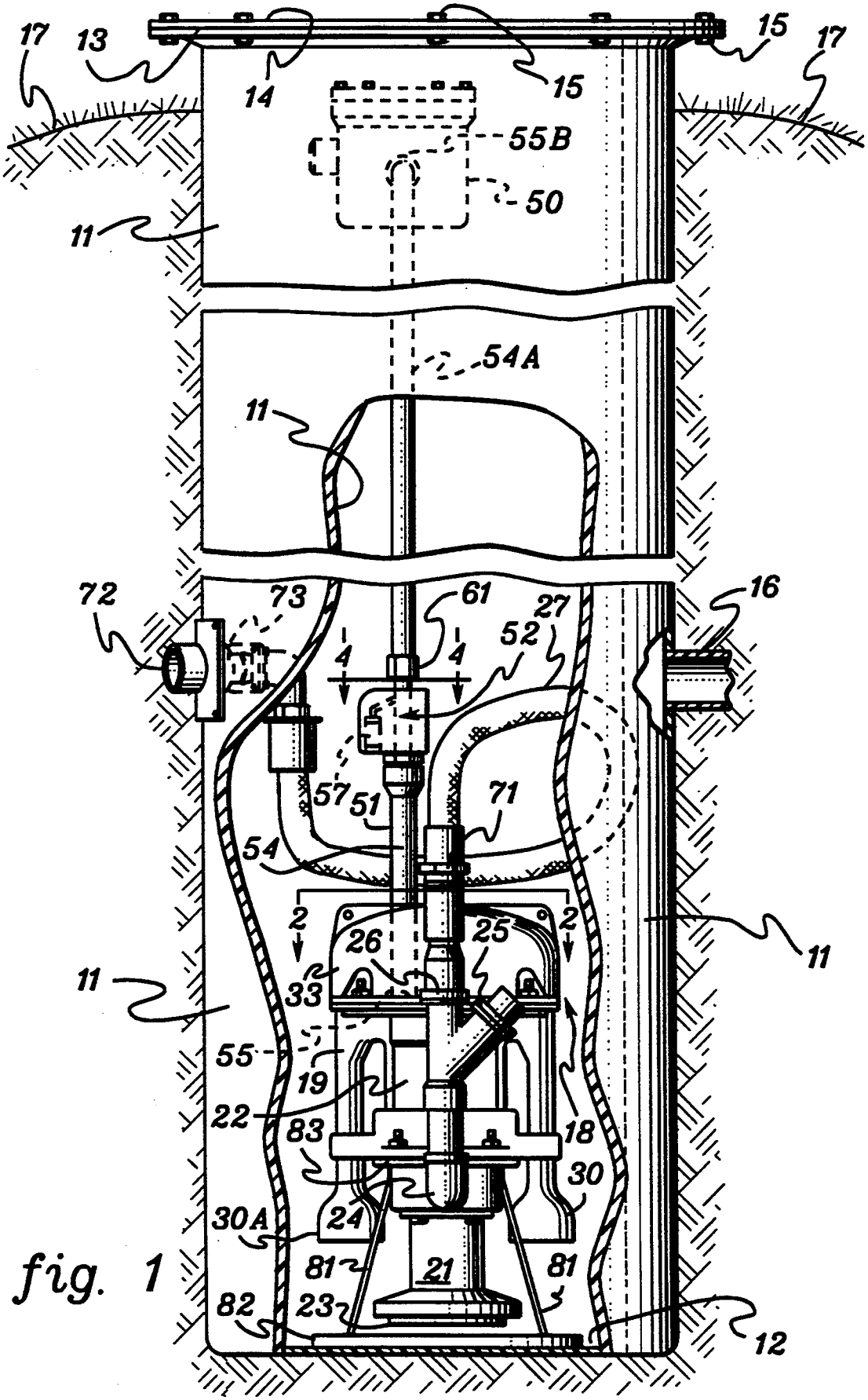
FIG. 1 is a fragmentary, vertical view, partly in section of the new and improved universal sewage grinder pump assembly comprising the invention installed in a sewage collection tank.

Referring to FIG. 1, the present invention provides a new and improved, easily installed, universal sewage grinder pump assembly 18 that readily may be installed in either newly constructed or previously built sewage collection tanks 11 which originally were designed for use with a wide variety of different types of pumps such as progressing cavity or centrifugal pumps with appended grinders. Installation or removal of the new universal sewage grinder pump assembly 18 can be accomplished from the surface with little effort on the part of the serviceman or installer and requires only a minimum number of interconnections to be made for connecting the sewage grinder pump assembly 18 to an electric power supply cable 54 and to a pressurized sewage discharge outlet conduit 27 for disposal of sewage pumped out of the collection tank 11. This can be done in a reliable, safe and permanent manner without requiring the installer or serviceman to enter into the collection tank 11 or to be physically exposed to its contents over an extended period of time.

Figure 3:
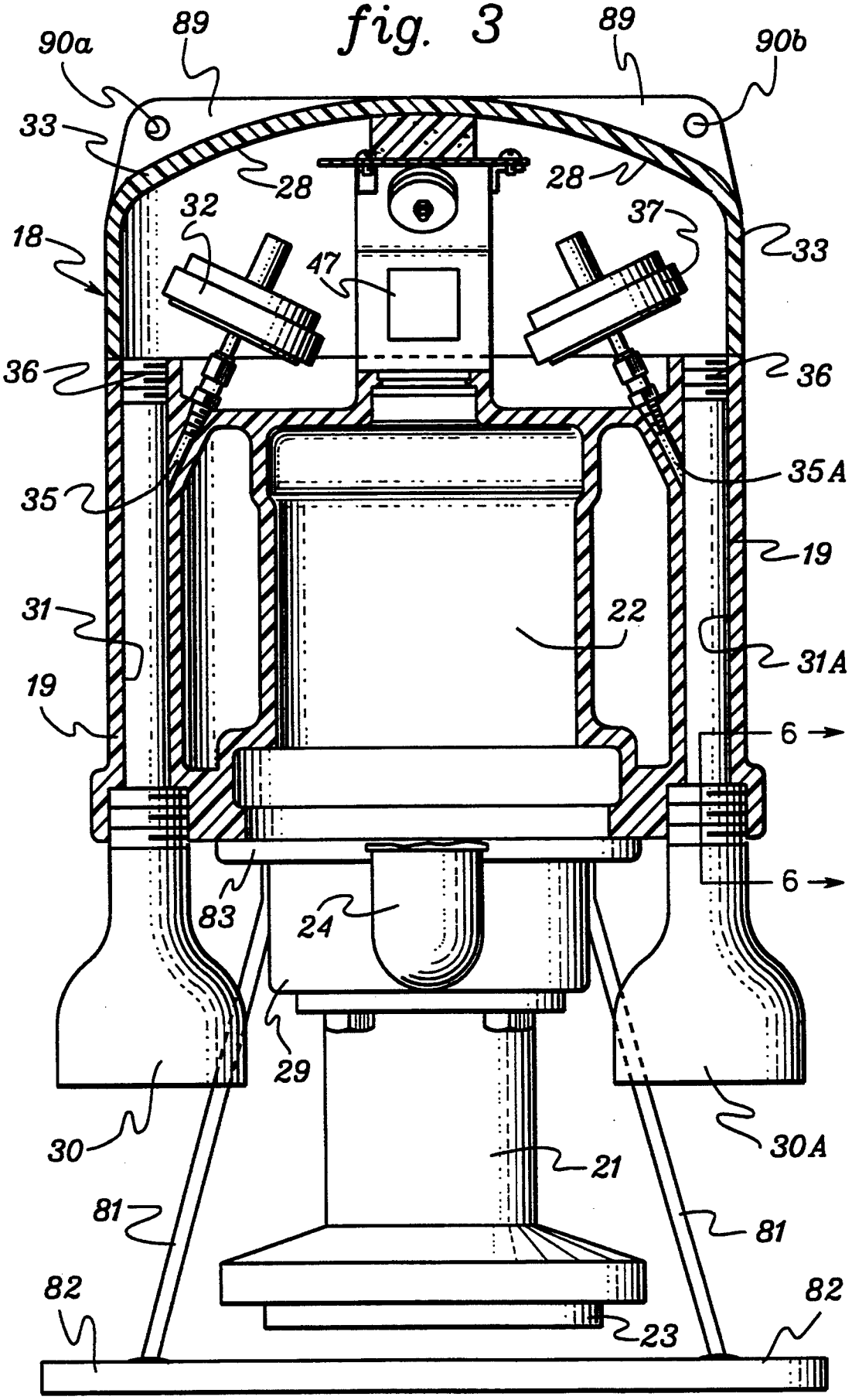
FIG. 3 is an enlarged vertical view, partly in section, of the novel grinder pump assembly taken along plane 3—3 of FIG. 2.

Reference is next made to FIGS. 1 and 3. In practicing the invention, an integral, readily installed, universal sewage grinder pump assembly 18 is provided which comprises an integral, liquid-tight outer housing 19 for supporting within a single liquid-tight containment vessel an electric motor driven grinder pump 21 along with at least one normal high (on) and low (off) liquid level sensing and control pneumatic pressure operated electric switch 32 supported within the same, integral, liquid- tight outer housing 19 for deriving on-off switching electric control signals for controlling normal on-off operation of the electric motor driven grinder pump 21. Liquid level sensing diving bell means 30 are supported on the integral housing and has at least one open lower end exposed to the liquid in the collection tank 11 (shown in FIG. 1) for deriving varying pressure pneumatic liquid level indicating signals for application to at least the normal high and low liquid level sensing and control pneumatic pressure operated electric switch 32 for deriving on-off electric control signals applied to sewage grinder pump motor 22. To protect the assembly, dynamically operated liquid level safety valve means 41 (shown in FIG. 6) are mounted within the sensing diving bell means 30 for preventing leakage of any liquid into the normal high and low liquid level sensing control, pneumatic pressure operated, on-off electric switch means 32 upon the liquid level in the passageway 31 exceeding a predetermined threshold level (e.g., when liquid in collection tank 11 exceeds a high liquid alarm level for a prolonged period of time and the gas in passageway 31 is absorbed into the liquid).

In preferred embodiments of the invention, the integral liquid-tight outer housing 19 contains a single, closed, liquid-tight chamber 28 in which the normal high and low liquid level sensing and control, pneumatic pressure operated, on-off electric switch means 32 is mounted. The varying pressure pneumatic liquid level indicating signals derived by the liquid level sensing diving bell means 30 are applied to one side only of the pressure operated, electric control switch means 32 for deriving the normal high and low, on-off electric control signals. The remaining side of the respective pressure operated, on-off electric control switch means 32 is vented to the interior of the single closed liquid-tight chamber 28 in the integral liquid-tight housing 19. The single closed liquid-tight chamber 28 is vented to a source of atmospheric pressure gas through an elongated, small diameter venting passageway 51P extending between the single closed liquid-tight chamber 28 in the integral, liquid-tight outer housing 19 and a breather point 52 higher up in the collection tank 11 than the sewage grinder pump assembly. The elongated small diameter venting passageway 51P is formed in the space between a flexible electric power supply cable 54 and the walls of a liquid-tight conduit 51 within which the power supply cable is mounted for supplying electric power from an electric power supply junction box 50 mounted high up near the top 14 of the collection tank 11 to the grinder pump motor 22 via the normal high and low liquid level sensing and control electric switch means 32.

The dynamically operated liquid level safety valve means 41 mounted within the level sensing diving bell means 30 comprises at least one float 41 operated cutoff safety valve located in an interconnecting passageway 31 between the level sensing diving bell means 30 and the normal high and low level sensing on-off control electric switch means 32 in the single, liquid-tight vented chamber 28 for preventing leakage of liquid into said sensing and control on-off electric switch means 32 via the liquid level sensing diving bell means 30 in the event of excessive fluid height within the interconnecting passageway 31 (e.g., due to prolonged high liquid levels in excess of the alarm high liquid level or due to an open loop).

In addition, a venting passageway, float operated, safety stop valve 57 is interposed in the breather assembly for the single, liquid-tight chamber 28 at a breather point 52 higher up in the collection tank 11 in which the grinder pump assembly 18 is mounted near the point where the venting passageway 51P is vented to a source of gas at atmospheric pressure. In a further preferred embodiment of the invention, the liquid level sensing diving bell means comprises two separate liquid level sensing diving bells 30 and **30*a* secured to the bottom of the integral liquid-tight housing 19 and extending downwardly therefrom with the lower bottom end of each liquid level sensing diving bell 30 and 30*a* being open and exposed to the flow of the liquid thereinto whenever the open end of either diving bell 30 or 30*a* is below the surface of the liquid in the collection tank. One of the level sensing diving bells 30 serves to derive the normal high and normal low, on-off electric control switching signals for controlling on-off operation of the grinder pump 21. The remaining level sensing diving bell 30*a* serves to derive a high liquid level alarm control signal that is supplied to one side of a second pneumatic pressure actuated, electric control switch 37 also mounted in the closed liquid-tight chamber 28 with the second side of the second pressure actuated electric switch 37 being vented to the interior of the closed chamber 28 and hence to a source of gas at atmospheric pressure. The dynamically operated liquid level safety cutoff valve means comprises individual float operated cutoff safety valves 41 located in the respective interconnecting passageways 31 and 31a from the respective liquid level sensing diving bells 30 and 30*a* to the common, single liquid-tight chamber 28 in which the respective normal high and low liquid level sensing and control pressure operated electric switch 32 and the high liquid level alarm sensing control pressure operated electric switch 37, are supported. These float operated cutoff safety valves 41 dynamically prevent leakage of liquid into the respective sensing and control switches 32 and 37 via the respective liquid level sensing diving bells 30 and 30*a* in the event that the liquid level in interconnecting passageways 31 and 31*a*** rise above a predetermined threshold level.

In further preferred embodiments of the invention, the electric motor 22 driving the grinder pump 21 is a submersible electric motor having its own liquid-tight housing so as to provide redundant protection against leakage of liquid into the vital parts of the motor 22 and the pump 21 is a progressive cavity-type, semi-positive displacement pump. Additionally, the grinder pump 21 has an integrally formed anti-siphon valve 25 and an integrally formed discharge check valve 26 mounted on the discharge end thereof. Further, the discharge outlet 24 of the sewage grinder pump 21 is coupled through an adaptable discharge conduit 27 of sufficient and adjustable length to provide a liquid-tight high pressure connection from the discharge outlet 24 of the grinder pump 21 through a suitable quick connect-disconnect coupling 73 mounted on the side of the collection tank 11 to a pressure sewage disposing system .exterior of the collection tank 11.

Additionally, the universal sewage grinder pump assembly 18 according to the invention includes a support stand 81 for holding the integral liquid-tight housing 19 containing the electric motor driven sewage grinder pump 18 upright in a balanced stable position within a collection tank 11 and with the open intake end 23 of the sewage grinder pump spaced an appropriate distance relative to the bottom of the collection tank 11 to assure proper scouring of the bottom during operation of the grinder pump 21 to thereby prevent buildup of solids on the bottom.

THE EXEMPLARY EMBODIMENTS OF THE INVENTION

FIG. 1 is a longitudinal sectional view of a conventional sewage collection tank 11 which has been buried below the surface in the backyard or cellar of an individual family residence, or the like. For convenience, one side of the tank has been partially broken away in order to illustrate the manner of placement of the readily installed universal sewage grinder pump assembly comprising the invention within the collection tank 11. Collection tank 11 may be of concrete, fiberglass or suitable plastic material which is impervious to liquid and includes an integrally formed bottom 12, and may be either a new or a preexisting tank which has been refurbished. The tank is generally cylindrical in cross-section, but could be any desired configuration such as square, rectangular or the like with an upper flanged edge 13 on which a removable top 14 is mounted by machine screws, bolts 15, or the like. Collection tank 11 is planted in the ground to a suitable depth below the surface of the ground or cellar floor shown at 17. Sewage collection tank 11 after installation is connected by means of an inlet opening formed on the side wall thereof to an inlet pipe shown at 16, of a suitable gravity drain-type sewage piping system that is interconnected between the facility to be serviced and the sewage collection tank 11 in which liquid sewage is collected.

The readily installed, universal sewage grinder pump assembly comprising the present invention is shown generally at 18 in FIG. 1 and in greater detail in FIGS. 3 through 8 of the drawings. With reference to FIG. 3, the integral, readily installed, universal sewage grinder pump assembly 18 forms an integral, liquid-tight housing 19 that comprises a single, liquid-tight containment vessel for an electric motor driven grinder pump formed by an electric motor 22 and pump 21. Motor 22 is a conventional, commercially available motor which relies on housing 19 for protection against leakage of fluid into the working parts. However, if desired, motor 22 could be a submersible electric motor having its own liquid-tight outer containment casing which in effect provides double protection against leakage of liquid into its interior.

The pump 21 has a grinder unit 23 mounted on the suction intake side thereof for shredding and pulverizing liquid sewage collected in the collection tank 11 and preferably is a progressing cavity-type, semi-positive displacement pump. The sewage grinder pump unit comprised by elements 21, 22 and grinder 23 may be of the same general construction and operating characteristics as the sewage grinder pump described in Reissue U.S. Pat. No. 28,104. The sewage grinder pump has its discharge on the backside of the sewage grinder pump assembly 18 as shown partially at 24 in FIG. 3. The discharge outlet 24 from the progressing cavity-type, semi-positive displacement pump 21, as best seen in FIG. 1, is coupled through an automatically operating anti-siphon valve 25 and an integrally formed, automatically operating discharge outlet check valve 26, all integrally formed and mounted on a casting 29 that forms the discharge chamber for pump 21 and is bolted to the bottom of housing 19 and is connected to a pressurized sewage discharge conduit 27 to be described more fully hereafter. The construction and operating characteristics of anti-siphon valve 25 and outlet check valve 26 are described more fully in U.S. Pat. No. 3,857,517 issued Dec. 31, 1974 and the details of construction and operation of the grinder unit 23 are described more fully in Reissue U.S. Pat. No. 28,104 issued Aug. 6, 1974. Both patents are assigned to the Environment/One Corporation of Schenectady, New York, and the disclosures of each hereby are incorporated into the disclosure of this application in their entirety.

Figure 2:
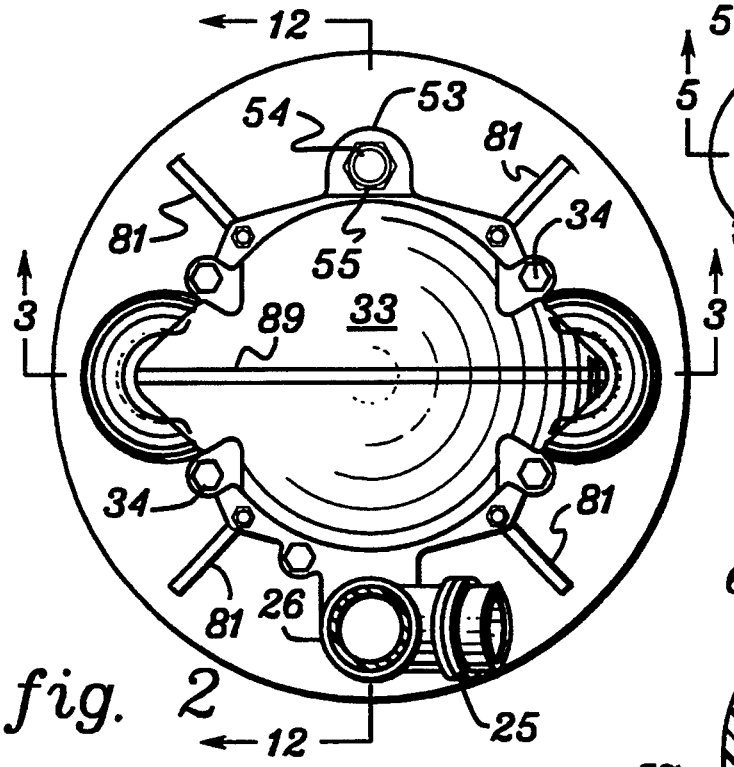
FIG. 2 is a top view of the new and improved grinder pump assembly taken along plane 2—2 of FIG. 1.

Normal high and normal low liquid level sensing control means are supported on the integral outer housing 19 for deriving on-off switching electric control signals for controlling normal on-off operation of the electric motor driven grinder pump 21, 22, 23. This on-off control means is comprised by a first liquid level sensing diving bell 30 which is threadably supported on the lower end of housing 19 and communicates through an integrally formed open air passageway 31 formed on one side of housing 19. Passageway 31 communicates with one side of a pneumatic pressure actuated control switch 32 of conventional, commercially available construction which is physically mounted within an open air chamber 28 beneath a dome-shaped top 33 secured to the top of the housing 19 by means of machine bolts 34 as best shown in FIG. 2 of the drawings. Air trapped in the chamber 28 is maintained at atmospheric air pressure by means of a venting passageway to be described more fully hereafter.

The air trapped in the open air passageway 31 above liquid level sensing bell 30 forms a pneumatic air column whose pressure varies with the liquid surface level in diving bell 30 and/or more importantly with the liquid level in collection tank 11. This varying pressure pneumatic signal is supplied through an angled passageway 35 formed in housing 19 to the bottom liquid and airtight side of a pressure sensitive diaphragm of pressure actuated switch 32 mounted in the space under dome 33. The end of the open air passageway 31 is plugged at the end adjacent dome 33 by a threaded, airtight plug 36 threadably secured in the top of air passageway 31 to prevent any leakage of air or liquid into chamber 28 directly from passageway 31. The liquid level sensing diving bell 30 is mounted on housing 19 with its open bottom end facing downwardly toward the bottom of tank 11 whereby as liquid sewage contained in tank 11 accumulates, its surface level rises above the open end of diving bell 30 and traps a pneumatic air column within the passageways 31, 35. As the surface of the liquid sewage rises higher in diving bell 30 the pressure of this pneumatic air column increases until it is sufficient to actuate the pressure sensitive diaphragm of switch 32 and causes it to close the contacts of a starting switch 47 to thereby turn on and activate the motor 22 of the grinder pump unit 21. After turn-on, the grinder pump will pump out the contents of collection tank 11 to a low level where the pressure of pneumatic air column trapped in passageways 31 and 35 allows the pressure actuated switch 32 to be automatically returned to its off condition thereby de-energizing excitation of motor 22. In this manner on-off cyclic pattern of control, dependent upon the level of liquid sewage collected in tank 11 is developed by on-off control switch 32. Under normal operating conditions, this cyclic on-off operation of the sewage grinder pump will continue at a pace determined by the rate of filling collection tank 11 which in turn is determined by the frequency of usage in the facility being serviced.

Because operating conditions are not always normal and perturbations will occur due to a variety of reasons, a high liquid level alarm sensing and control means also is provided within the integral, liquid-tight housing 19. This high liquid level alarm sensing and control means senses abnormally high fluid level alarm conditions in the collection tank and derives an output alarm control signal for providing a remote liquid high level alarm indication to an accessible operator panel location for informing an operator of the sewage grinder pump assembly of the high level alarm condition. If desired, this high liquid level alarm signal also can be used for redundantly energizing the motor driven pump 22, 21, upon sensing high liquid level alarm conditions in the collection tank, as disclosed in U.S. Pat. No. 4,919,343. For this purpose, a second liquid level sensing diving bell 30A of identical construction to the first diving bell 30 is threadably secured to the lower end of a second open air passageway 31A formed in the opposite side of housing 19 from the first diving bell 30 open air passageway 31 described previously. A second conventional, commercially available, pressure actuated switch 37 also is mounted in the common atmospheric pressure chamber 28 under dome 33 and has only its lower liquid-tight pressure actuated diaphragm exposed to the varying pressure, pneumatic air column trapped in passageway 31A via an angled passageway 35A also formed in housing 19. The opposite side of the pressure sensitive diaphragm in switch 37 is exposed to the atmospheric pressure trapped in the common chamber 28 in the same manner as the on-off control switch 32 so that both switches are assured of being calibrated against the same reference level atmospheric air pressure.

During operation, the high liquid level alarm sensing and control subsystem comprised by the second diving bell 30A, open air passageways 31A, 35A and second pressure actuated switch 37 all function in the same manner as described above with respect to the on-off cycle control of the sewage grinder pump motor to provide high liquid level sensing and alarm with the exception that the second pressure actuated control switch 37 is set to function at a different, higher, alarm pressure level than that of on-off control switch 32 for the grinder pump motor. For a more detailed description of the operation and coaction of the combined on-off cyclic control and the liquid high level alarm sensing and signaling, and the manner of their interconnection so as to provide redundant excitation of the grinder pump motor 22 through the liquid high level alarm control switch 37, if desired, reference is made to U.S. Pat. No. 4,919,343 issued Apr. 24, 1990 for a "Anti-Flooding Sewage Grinder Pump Liquid Level Control System . . . " by Frank W. Van Luik, Jr. and Eric F. Cabahug, assigned to the Environment/One Corporation of Schenectady, New York, the assignee of the present invention, the disclosure of which hereby is incorporated into the disclosure of this application in its entirety.

Again, because normal operating conditions are not always present, and further because of the possibility of prolonged power outages in certain areas, the high liquid level sensing and control means may not be adequate to protect the sewage grinder pump assembly under all conditions of operation. For this reason, the new and improved universal sewage grinder pump assembly comprising the invention further includes liquid level safety cutoff valve means mounted within the liquid level sensing diving bell means for cutting off access of liquid fluid to both the normal on and off liquid level sensing and control means pressure sensitive switch and to the high liquid level alarm sensing and control pressure sensing switch upon the liquid level in the sensing diving bell means exceeding a predetermined level and even perhaps overflowing.

Figure 6:
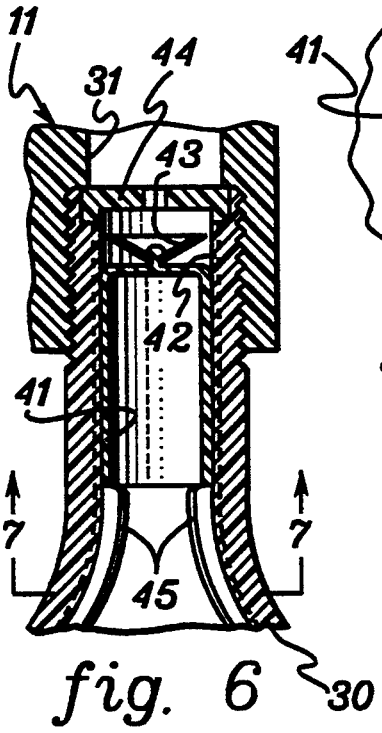
FIG. 6 is an enlarged fragmentary vertical sectional view of the dynamically operated, float cutoff safety valve located in the interconnecting passageway from the liquid level sensing diving bells taken through plane 6—6 of FIG. 3.

FIG. 6 of the drawings is a partially broken away, longitudinal sectional view of the narrow neck portion of the liquid level sensing diving bells 30 or 30A (assumed to be 30 in FIG. 6) wherein the extremely high liquid level safety cutoff means is shown to be a float operated cutoff safety valve seen at 41 which comprises a cup- shaped float supported within an enlarged chamber 42 formed within the narrow neck portion of diving bell 30. The float valve 41 comprises an upside down, cup-shaped float member having an inverted conically-shaped, flexible sealing member 43 secured to the inverted bottom thereof. Sealing member 43 is designed to cover and close the orifice of a small orifice plate 44 secured over the top and enclosing the chamber 42 with float valve 41 in its raised upper position. During normal operations, the float member 41 is designed to rest upon a plurality of internal ribs 45 formed on the inside surface of the narrow restricted portion of the central passageway through the liquid level sensing diving bells 30, 30A, with the upper ends of the ribs 45 forming a plurality of supports for the float member 41 open lower edge as best shown in FIG. 7 of the drawings.

Figure 7:
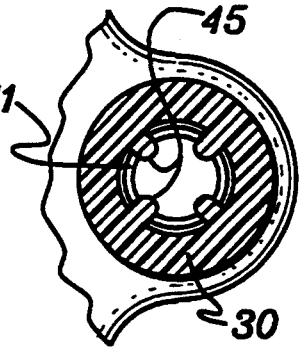
FIG. 7 is a fragmentary, horizontal, cross-sectional view through the neck of the liquid level sensing diving bell taken along plane 7—7 of FIG. 6.

During normal operating conditions, the dynamically operable float member 41 together with the conically-shaped sealing member 43 rests on the upper ends of the supporting ribs 45 as shown in FIGS. 6 and 7. In this condition, the pneumatic air column trapped above the liquid level surface in each of the diving bells can freely exert pressure within the bell past the float valve 41, through the aperture in aperture plate 44 and the open air passageways 31 and 35 in body member 19 of FIG. 3 to act upon the pressure sensitive contact members of on-off control switch 32 (or high liquid alarm level switch 37). As best seen in FIG. 3, in the event of extreme high water levels which exceed a predeteremined level (the predetermined level may be above the alarm high liquid level setting of switch 37), due perhaps to an extended power outage, if the liquid level reaches the narrow neck portions of the liquid level sensing diving bells 30, 30A the float member 41 will be caused to float upwardly. Upon reaching the top of its movement, cup-shaped seal 43 will close the aperture opening in apertured plate 44 thereby dynamically closing off any possible leakage path of the liquid in the collection tank proceeding on up and into the pressure actuated switch contact portions of switches 32 and 37 or otherwise leaking into the open space in common chamber 28 in which, not only the pressure actuated switches 32 and 37 are mounted, but also other components of the starting, running and control circuitry for the pump motor such as a starting capacitor 46 and starting relay 47 and motor contactor 48 mounted on a chassis 49.

Figure 4:
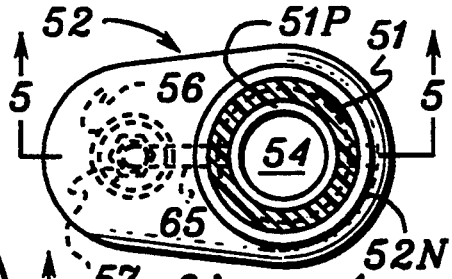
FIG. 4 is an enlarged cross sectional view, partly in section, of the breather tube check valve for the grinder pump assembly taken along plane 4—4 of FIG. 1.
Figure 5:
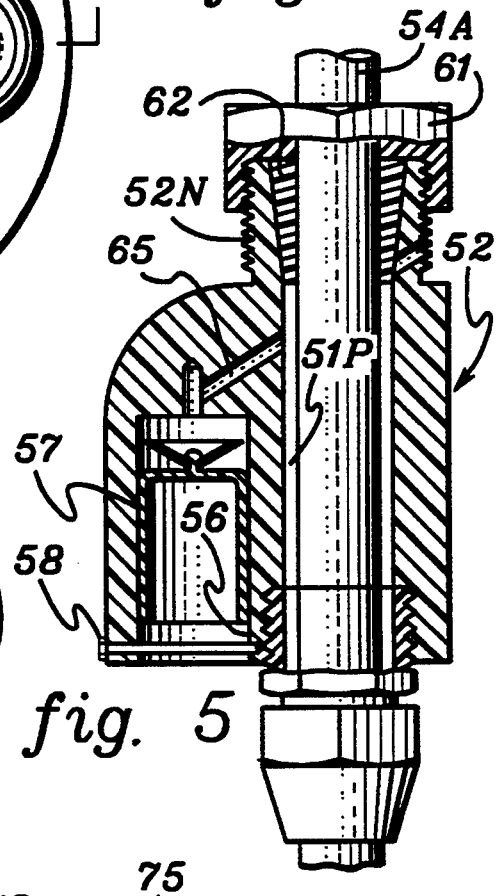
FIG. 5 is a vertical sectional view of the breather tube check valve assembly taken along plane 5—5 of FIG. 4.
Figure 12:
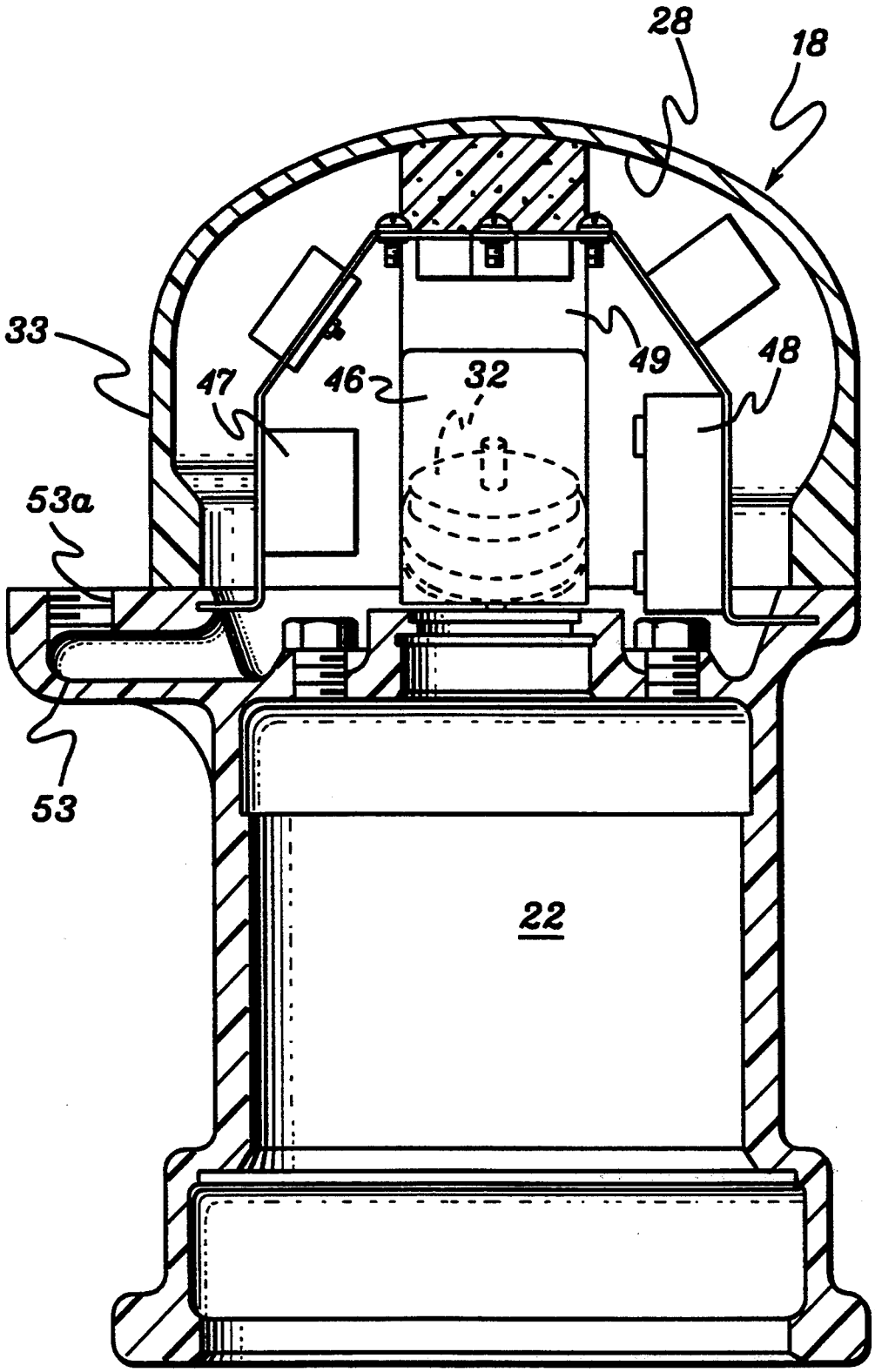
FIG. 12 is a partial cross-sectional view of the pump assembly shown in FIG. 2.

As noted earlier in this description, the common chamber 28 within the dome-shaped top 33 of outer housing 19 is maintained at atmospheric pressure. For this purpose, the space must be vented to a source of atmospheric pressure. To do this, a relatively small diameter venting passageway, shown at 51P in FIGS. 1, 4 and 5 is interconnected between a small venting passage 53 (shown in FIG. 2) to the space below dome-shaped top 33, and a breather device shown at 52 high up, closer to the top of the sewage collection tank 11. The venting tube passageway 51P between chamber 28 and breather device 52 is provided through a small diameter opening 53 formed in a flange disposed on the upper top edge of housing 19 on which dome 33 is seated, as best seen in FIGS. 2 and 12. FIG. 12 is a partial cross sectional view of the pump assembly 18 shown in FIG. 2. The opening 53 includes a threaded vertical passage **53*a* for receiving the watertight coupling 55**.

The venting tube portion 51P that extends between the breather device 52 and the opening 53 into chamber 28 within dome-shaped top 33 in fact comprises an electric power cable 54 for also supplying electric power to the electric motor driven grinder pump via the control switch 32. The power cable segment 54 is surrounded by an outer, watertight, waterproof, impervious sheathing 51 which extends only between the breather device 52 and a watertight coupling 55 (similar to the coupling 55A shown in FIG. 5) that secures the lower end of the sheathed electric power cable 54 through opening 53 in a watertight manner for connection to the parts within liquid-tight chamber 28. The upper end of the electric power supply cable 54A is secured to the breather device 52 by a watertight coupling 55A passes through the breather device 52 (as best shown in FIG. 5) and goes on up to a liquid-tight junction box 50 mounted up close to the top cover 14 of collection tank 11 to which it is connected by another liquid-tight coupling 55B, similar to 55A. Junction box 50 is connected to an electric power source externally of collection tank 11.

The space between the outer sheath 51 and the inner lower segment of power cable 54 constitutes the venting passageway 51P for venting chamber 28 under dome-shaped top 33 to atmospheric pressure air that collects in the space in collection tank 11 above the surface of the liquid sewage collected in the tank. This is best shown in FIGS. 4 and 5 which are, respectively, a horizontal cross- sectional view and a longitudinal sectional view of the breather device 52. Above the breather device 52 there is no longer any need for the liquid- tight, impervious outer sheathing 51 that forms the venting air passage 51P in the space between inner power conductor cable 54 and sheathing 51. Consequently, only the inner core portion 54A of the power supply conductor extends above the breather device 52 to the input electric power supply junction box 50. The junction box 50 is a liquid-tight enclosure to which the power supply cable 54A is connected via a liquid-tight threaded coupling 55B. By this construction, it is possible to provide only a single elongated power supply cable 54 having a loose fitted, outer, liquid-tight impervious sheathing 51 in the length of power cable between the breather device 52 and the sewage grinder pump assembly thereby obviating the need for a serviceman to install both a separate air venting tube fixture and electric power supply cables in the interior of the collection tank 11.

The breather device 52 is adjustably secured (but once set is fixed in position) midway the length of the electric power cord 54, 54A above the motor and above the high alarm liquid level. This is achieved by means of a threaded coupling comprised by a threaded cap 61 that coacts with a threaded neck portion 52N formed on the top side of the breather device 52. A tapered grommet 62 having a central opening through which the power cable 54A passes and which is fabricated from pliable material such as rubber, or soft pliable plastic material, is compressed between the power cable portion 54A and the inside of the threaded neck portion of breather device 52 in a manner such that as the threaded cap 61 is drawn down on the threaded neck portion of breather device 52 it clamps the breather device to the power cord 54A and holds it in place in a liquid-tight connection. In order to function as a breather device, the body member of breather device 52 has an angled passageway 65 formed therein which extends between the central passageway accommodating the power cable 54 and outer sheathing 51 and a cylindrically-shaped chamber 56 on the bottom side of breather device 52. Disposed in the chamber 56 is an inverted, cup-shaped float 57 which is maintained in position within chamber 56 by a pin 58 under normal operating conditions where the breather device 52 is well above the surface of the liquid contained in collection tank 11. Under these conditions, the float 57 drops down and rests on pin 58 and is sufficiently loose within chamber 56 that the angled air passageway 65 is able no communicate with air contained in the upper portion of collection tank 11 thereby opening up a venting passageway from the top of the collection tank past the sides of the float 57, through angled passageway 65 and down into the venting air passageway 51 between the power supply cable 54 and the outer sheathing 51 through opening 53 (shown in FIGS. 2 and 9) to chamber 28 under the dome-shaped top 33 of the sewage grinder pump assembly housing 19.

In the event of extremely high liquid levels occurring in collection tank 11 due, for example, to a prolonged power outage, if liquid rises to and above the level of the breather device 52 in collection tank 11, the float 57 is caused to float upwardly and close off access of liquid through the angled venting air passageway 65 into the venting tube space 51P by means of a second, inverted, conically-shaped flexible sealing member 43A. With this construction it is assured that even if collection tank 11 is completely filled with liquid, or at least to the level of the inlet supply conduit 16, no permanent damage would be done to the critical components of the sewage grinder pump assembly. This is due to the dynamically operated float valve 57 in the breather device 52 and cutoff float valves 41 in each of the liquid level sensing diving bells 30 and 30A which close off all air passageways required in the normal functioning of the sewage grinder pump in much the same manner that a clam or oyster closes its shell when it senses adverse operating conditions. Accordingly, the new and improved universal grinder pump assembly dynamically converts itself into a completely liquid-tight containment condition which will avoid possible permanent damage to the assembly even for prolonged periods until the adverse operating condition of extremely high liquid levels in the collection tank is corrected.

Referring again to FIG. 1 of the drawings, it will be seen that sewage output discharge from the sewage grinder pump assembly after passing through the output check valve 26 is connected through a conventional, threaded, liquid-tight coupling 71 to one end of a submersible, adaptable length conduit 27 of greater length than that required to reach pipe 72 which is installed well up on the sidewalls of collection tank 11 for dispensing the ground pressurized sewage to a suitable dispensing system such as a fiberglass septic tank, a septic field, a network of pressurized sewage piping, or the like. The outlet piping 72 is connected to a permanently mounted back plate of a two, three or other multi- part, quick connect-disconnect slide coupling provided for physically supporting the discharge end of flexible discharge conduit 27 into tightly coupled, liquid-tight relationship with the output piping 72. For this purpose a quick connect-disconnect two-part slide coupling of the type disclosed and claimed in U.S. Pat. No. 4,822,213 cited above and previously expressly incorporated into the teachings of this application, may be used. Preferably, however, a three or other multi- part coupling of the type disclosed and claimed in U.S. Pat. No. 5,038,817 issued Aug. 13, 1991—Clark A. Henry, Eric F. Cabahug, Jack L. Cooley and Richard C. Grace, inventors—also assigned to the Environment/One Corporation of Schenectady, N.Y., may be used. The disclosure of U.S. Pat. No. 5,038,817 also expressly is incorporated by reference in its entirety into the disclosure of this application.

Either of the above-mentioned slide couplings may be slide interconnected with or disconnected from the permanently mounted back slide coupling portion secured to the inside of collection tank 11 and permanently interconnected with the outlet connection pipe 72. This may be done by a serviceman from the surface of the ground by means of a pole, rod or the like maneuvered by the serviceman through the open top 14 of the collection tank 11 when initially installing, or removing the sewage grinder pump assembly 18 from the inside of the collection tank once it has been cleared of any previously installed equipment that may have been used therein in the case of existing collection tanks. In order to adapt the sewage grinder pump assembly 18 comprising the invention for use with many different types, sizes and configurations of collection tanks, the discharge conduit 27 is made of sufficient length to reach from a point relatively low down on the side of the collection tank 11 up to a much higher point, perhaps even above the sewage inlet 16 if necessary. Hence, the sewage grinder pump assembly 18 is universal in the sense that it readily can be installed in almost any previously constructed sewage collection tank without requiring substantial adaptations no the collection tank itself other than to clear away any previously installed sewage grinder pump or supporting access equipment.

Figure 8:
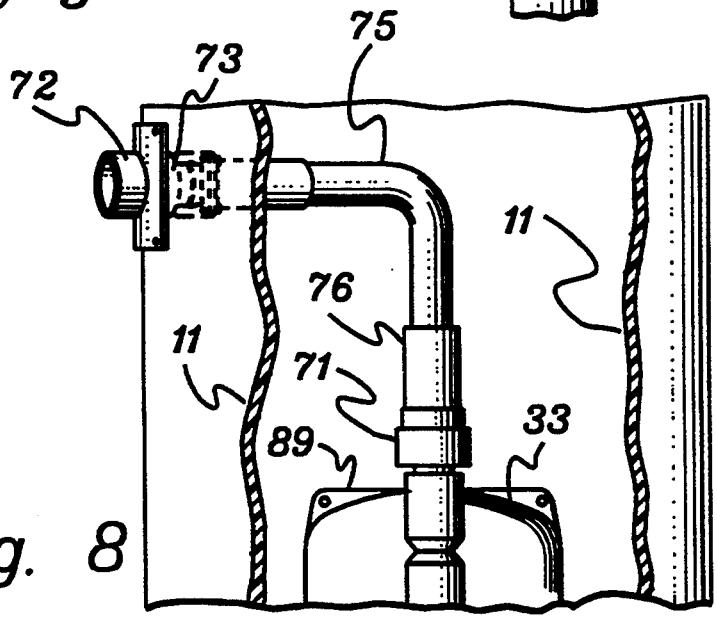
FIG. 8 is a fragmentary, vertical view, partly in section, showing a modification of the discharge conduit coupling between the discharge outlet of the grinder pump and a quick connect-disconnect slide coupling mounted high up on the sidewalls of the collection tank.

FIG. 8 is a partial fragmentary view of a different design adjustable length discharge output conduit subassembly for adapting sewage grinder pump assembly 18 for use with widely different types of sewage collection tanks 11. In the embodiment shown in FIG. 8, the discharge conduit 75 is connected between the discharge outlet 71 of the sewage grinder pump assembly 18 and the movable plate of a quick connect-disconnect coupling 73. Discharge conduit 75 may be a length of stainless steel piping or may be plastic such as PVC plastic which is bent in a substantially right angle with the lower end thereof slide fitted into a slide coupling 76 and held therein in a liquid-tight fashion, with either a threaded compression fitting such as shown at 98 and 99 in FIG. 11. Slide coupling 76 holds the lower otherwise free end of discharge conduit 7-5, which previously has been trimmed to the right length, firmly in place in the discharge outlet of the sewage grinder pump assembly 18 in a liquid-tight manner. During installation, the end of the discharge conduit 75 that is to be connected to the movable coupling plate of the quick connect-disconnect slide coupling is pre-mounted in advance of installation and the lower bent end portion cut so that it can be inserted into slide coupling 76, either by threadably engaging it with coacting threads formed on the slide coupling similar to FIG. 11, or by adhesives, or otherwise to form a permanent, liquid-tight connection to the discharge outlet of the sewage grinder pump 18. In operation, the discharge conduit 75 functions in the same manner as the coiled flexible discharge conduit 27 described with relation to FIG. 1 of the drawings, and may be preferred for use with smaller sewage collection tanks where space is limited and there is insufficient space to store a coiled length of the discharge conduit within the collection tank.

It is possible to support the universal sewage grinder pump assembly 18 in any desired effective manner by suspending it from a side or the top of the collection tank 11. A plate 89 having two holes **90*a* and 90*b* is integrally attached to the top of the housing 19, as shown in FIGS. 1–3, 8–9 and 12. The pump assembly 18 may be suspended by attaching a suitable cable to the holes 90*a* and 90*b* in plate 89 (The plate 89 is also used as a means for lowering the pump assembly 18 into the tank 11). However, the preferred means of support is through the use of a multi-leg stand 81 as shown in FIGS. 1 and 2 of the drawings. Stand 81 preferably has four legs which are welded or otherwise secured to a supporting ring 82 that can be placed on the bottom 12 of a collection tank with the upper ends of the legs 81 being welded to the bottom of the grinder pump assembly 11 or to an upper support ring 83 in which the grinder pump fits. The number of legs 81 provided are adequate to assure good stable seating and support for the grinder pump unit while it is operating, but are not too numerous or bulky to interfere with proper operation of the pump or cause clogging due to the legs catching solid objects and causing a buildup or accumulation of solids in the bottom of the tank. The spacing between the bottom of the grinder unit 23 and the bottom support ring 82 is designed so that the support stand holds the integral, light-weight, water-tight housing 19 in an upright, balanced stable condition within the collection tank and with the open intake end of the grinder pump spaced relative to the bottom of the collection tank (about 2 or 3 inches) to assure proper scouring of the bottom during operation of the grinder pump and thereby prevent buildup of solids on the bottom. To assure good longevity and safe operation, the stand 81, 82, 83** preferably is made of stainless steel or some other rustproof-corrosionproof material.

Figure 9:
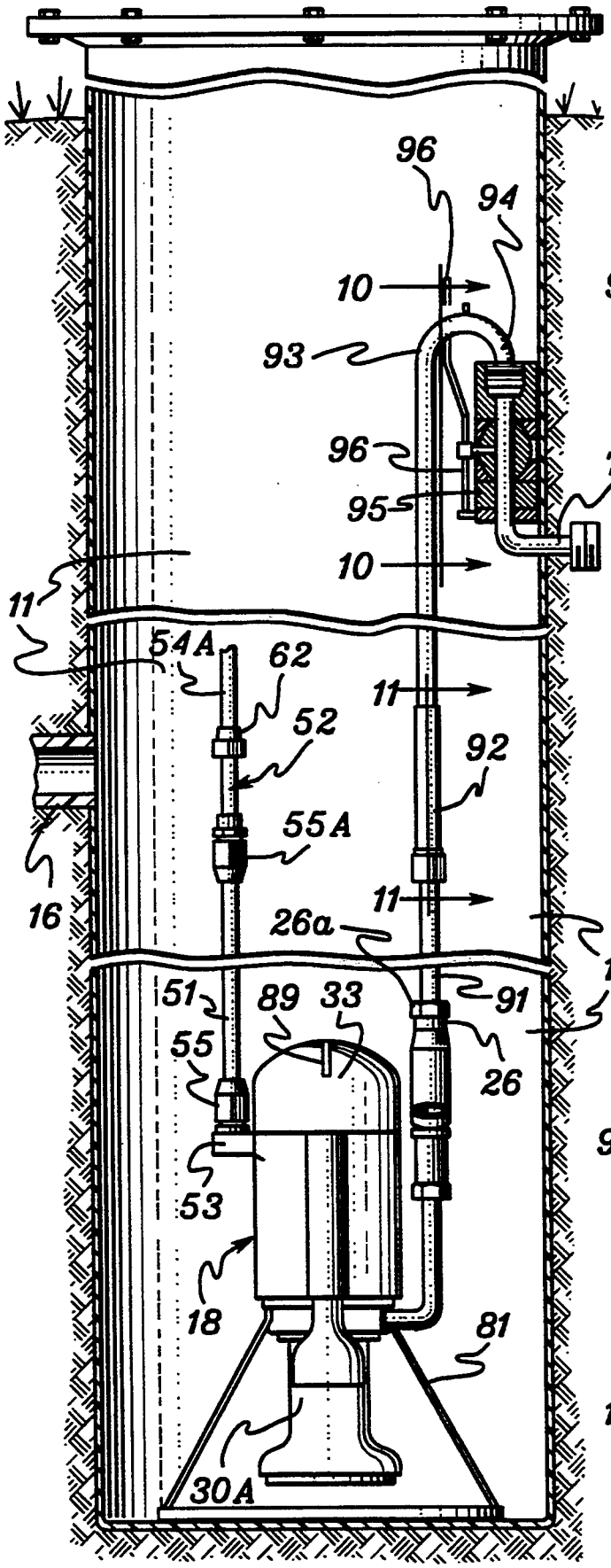
FIG. 9 is a fragmentary, elevational, vertical view of still a different modification of the adaptable discharge conduit sub-assembly employing non-flexible pipes within a slide coupling and a ball-type output discharge valve.
Figure 10:
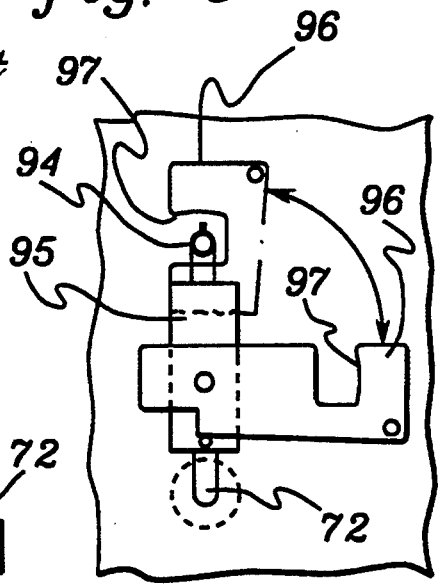
FIG. 10 is an enlarged, partial, fragmentary elevational view of the ball-type discharge valve employed in the modification of the invention shown in FIG. 9.
Figure 11:
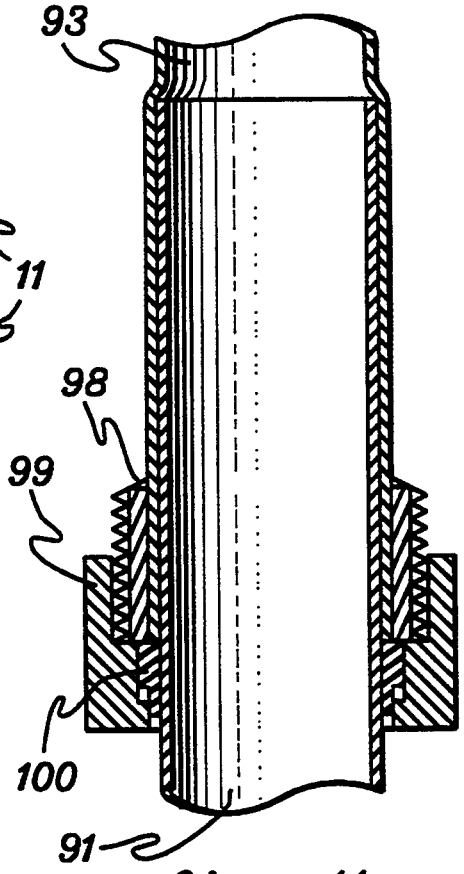
FIG. 11 is an enlarged, fragmentary, longitudinal sectional view of the slide coupling employed with the discharge arrangement shown in FIGS. 9 and 10.

FIGS. 9, 10 and 11 show another alternative form of discharge conduit outlet construction which is less expensive than the discharge outlet conduit arrangement used with the embodiments of the invention shown in FIGS. 1 and 8 of the drawings. In FIG. 9 a sewage collection tank is shown at 11 with a universal sewage grinder pump assembly 18 according to the invention supported in the bottom of tank 11 by support stand 81. The discharge outlet connection 26 of sewage grinder pump 18 is coupled through a relatively long (as necessary) length of solid inflexible pipe 91 (preferably of stainless steel) through a slide coupling 92 to be described more fully hereafter with relation to FIG. 11, and through a return bend portion 93 to the input of a quick connect-disconnect ball valve coupling arrangement 95. Ball valve 95 has its discharge outlet physically supported on the side of the collection tank 11 relatively high up above the bottom of the tank with the outlet being connected to a discharge coupling of an outlet piping system 72.

FIG. 10 is a somewhat larger and therefor easier viewed illustration of the quick connect-disconnect discharge valve (which may be, for example, be a ball, globe or gate valve) which is of conventional, commercially available construction and has a rotatable lever am 96 which has a U-shaped depression 97 formed therein which is designed to snap-over and hold in place the return bend portion 93 of discharge pipe 91 with ball valve 95 in the closed position. Lever arm 96 causes the ball valve 95 to be rotated within its housing to either open or close a passageway through the valve. The inlet side 92 of the valve 95 is coupled or decoupled to the short end 94 of the return bend portion of pipe 93, and the outlet side of globe valve 95 is permanently connected to an outlet piping system 72. The coupling or decoupling of the short end 94 of discharge pipe 93 to the inlet side of ball valve 95 occurs simultaneously with the opening or closing of valve 95 and is actuated by the lever arm 96. The input to ball valve 95 comprises an input socket that accepts the short end 94 of discharge pipe 93. Ball valve 95 is shown in the open position in FIG. 10. In the closed position the U-shaped depression 97 in lever handle 96 snaps over the return bend portion and holds the bend portion in the position shown in FIG. 8. As stated previously, the outlet or discharge side of globe valve 95 is permanently connected through an outlet elbow which in turn is connected through the wall of collection tank 11 and to an outlet discharge pipe system 72 for dispensing the discharged ground, pressurized sewage.

While initially installing the discharge sub- system of FIGS. 9–11, a serviceman first cuts the lower length of conduit 91 to the proper length for connecting the discharge 26 of the grinder pump assembly 18 to the lower end of the discharge pipe 91. As shown in FIG. 11, the diameter of the lower end of the longer leg of return bend portion 93 is flared outwardly sufficiently to provide a slide fit over the diameter of the upper end of lower length 91 of the discharge conduit. It also has welded thereon a threaded end piece 98 which is externally threaded and coacts with an internally threaded ring coupling 99 that slides over the upper end of the lower discharge conduit portion 91, and that accommodates a ring grommet 100 of flexible material such as rubber for providing both a frictional stop and liquid-tight seal for the slide coupling. In the event of a collection tank which is somewhat shallower than that for which the lengths of the various segments were designed to fit, the end of the lower discharge conduit segment 91 can be cut off with a hacksaw, tubing cutter, or some similar tool so that the length of the overall conduit segments 91 and 93 fit the particular installation in question. After the above adjustments have been made, the coupling 99 is threaded onto the threaded collar 98 so as to compress the sealing grommet 100 and clamp the two pieces together in a solid, liquid-tight manner.

After the above fittings have been made to provide a desired length output discharge conduit 91, 93, the lever 96 is rotated by means of a long pole or pipe operated by the serviceman from the surface above the collection tank, to the open position shown in FIG. 10 with the clamping collar on the inlet side of the ball valve assembly 95 in its open (widened) condition. Thereafter, the return bend portion of the discharge conduit is disposed so that the short support leg 94 slides down into and is supported by the inlet to the discharge ball valve 95. The serviceman then rotates the lever 96 to open the ball valve and simultaneously close the clamping collar on the input side of ball valve 95 so that it grips the end 94 of the return bend portion 93 of the discharge conduit thereby permanently holding the adaptable length discharge conduit sub-assembly in place with the universal sewage grinder pump assembly in a particular collection tank installation.

Figure 13:
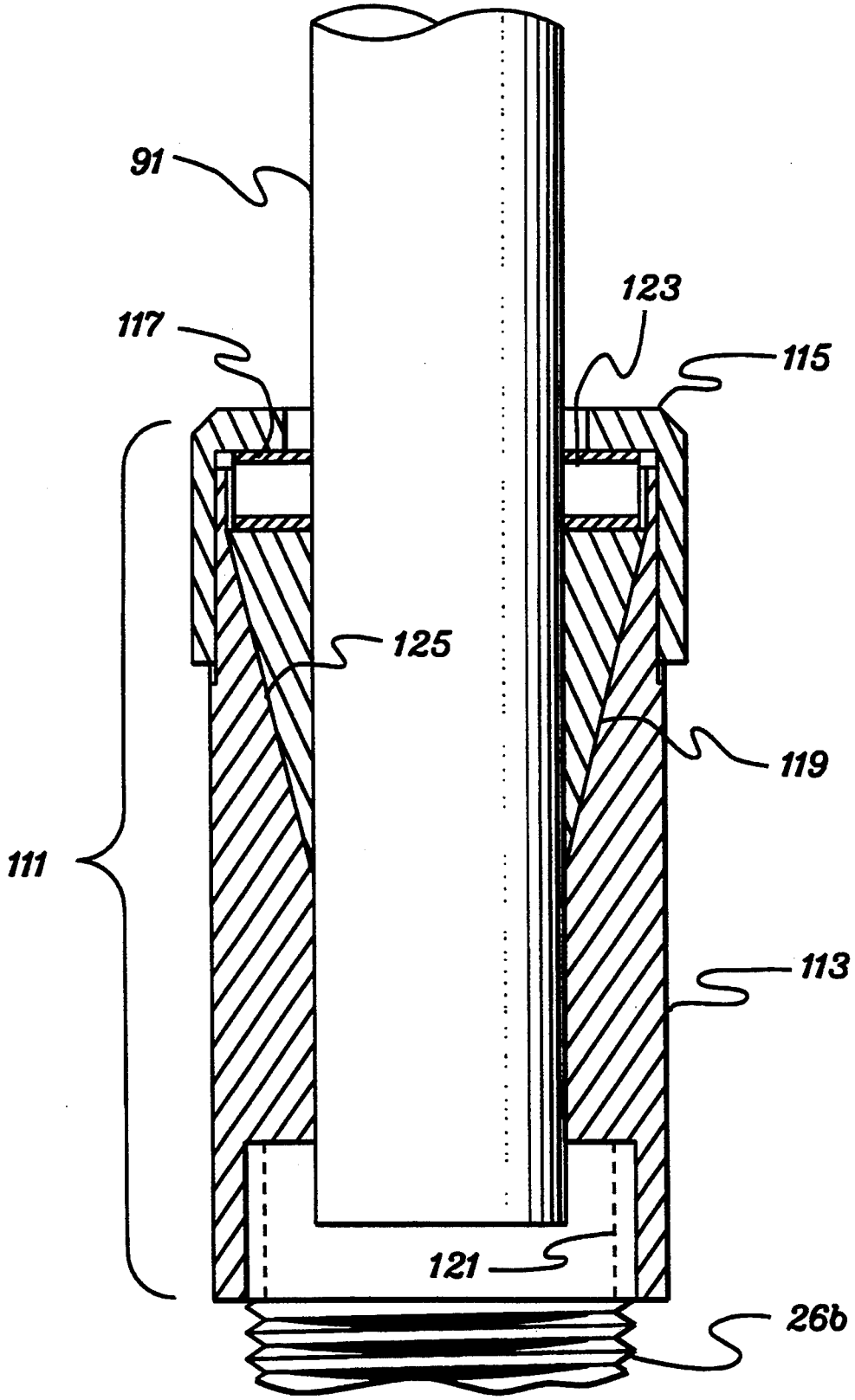
FIG. 13 is a cross sectional view of another embodiment of the discharge pipe coupling shown in FIG. 9.

FIG. 13 shows an alternative discharge conduit outlet construction. A fitting 111 is used in place of the slide coupling 92 shown in FIG. 9. The coupling nut **26*a* (shown in FIG. 9) is removed from the top of the discharge outlet check valve 26, exposing a top section that includes conventional fastening means, such as a pipe thread 26*b*. The fitting ill includes a body section 113. The body 113 has a receptacle 121 for sealingly receiving the top section 26*b* of the discharge outlet check valve 26. In the exemplary embodiment of FIG. 13, receptacle 121 has a female pipe thread. Body 113 may be formed by machining or by molding. FIG. 13 shows a body section 113 that is formed by machining. It is understood by one skilled in the art that a molded body section 113 would have less variation in wall thickness than is shown in FIG. 13**.

A collar 117 is provided within fitting 111 for receiving the discharge pipe 91. The collar 117 may be formed of a corrosion resistant metal, such as stainless steel. In the exemplary embodiment, four set screws 123 are provided for gripping the discharge pipe 91. A grommet 119 is positioned between the collar 117 and the inside surface 125 of body 113. The grommet 119 is formed of a resilient material, such as rubber, for providing a liquid resistant seal. A nut 115 attaches to the top of the body 113, and bears down against the collar 117, when the nut 115 is tightened. The collar 117 in turn bears against the grommet 119, to provide the seal.

The fitting 111 shown in FIG. 13 is relatively inexpensive to manufacture and simplifies installation. Ease of installation is particularly important when the worker is installing the fitting 111 and discharge pipe 91 from the ground level, above the collection tank 11.

While in the above description, the invention has been described primarily for use with a sewage grinder pump installations, it is believed obvious to those skilled in the art that the novel protective features made available by the invention are equally applicable for use in sump pumps, deep well pumps, submersible pumps and other similar underwater equipment in which it is desired to minimize the possibility of leakage of liquid into the vital operating parts of the equipment under extreme flooding conditions for prolonged periods of time.

INDUSTRIAL APPLICABILITY

The invention makes available new protective features for sewage grinder pumps, submersible pumps of all kinds, deep well pumps, sump pumps and other like equipment for minimizing the possibility of leakage of liquid into the vital parts of the equipment under extreme operating conditions and for prolonged period of time. Additionally, the invention makes it possible to adapt such equipment readily and easily to fit it for use with existing or predesigned collection tanks, deep wells and the like with a minimum effort and expense on the part of the serviceman. Finally, the invention makes available a universal pump assembly suitable for use in a number of widely different sewage disposal, pumping and like facilities which require replacement and repair of the electric pumping equipment previously used in such facilities.

Having described several embodiments of a new and improved universal sewage grinder pump assembly constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed:

1. An integral, readily installed, universal sewage grinder pump assembly comprising:

an integral, liquid-tight outer housing for supporting within a single liquid-tight containment vessel an electric motor driven grinder pump;

normal high and normal low liquid level sensing and control means supported within said integral liquid-tight outer housing for deriving on-off switching electric control signals for controlling normal on-off operation of the motor driven pump;

liquid level sensing diving bell means supported on said integral housing and having at least one lower open end exposed to the liquid in the collection tank for deriving liquid level indicating signals for application to said normal high and normal low liquid level sensing and control means; and dynamically operable liquid level safety cutoff valve means mounted within said sensing diving bell means for cutting off access of liquid fluid to said normal high and normal low liquid level sensing and control means upon the liquid level in the sensing diving bell means exceeding a predetermined level.

2. A universal sewage grinder pump assembly according to claim 1 wherein the integral outer housing contains a single closed liquid-tight chamber in which the normal high and low liquid level sensing and control means are mounted, the liquid level sensing diving bell means derives pressure varying pneumatic, liquid level indicating, signals that are applied to one side only of a pressure sensitive electric control switch for deriving the normal high and low electric control signals with the remaining side of the pressure sensitive electric control switch being vented to the interior of the single closed liquid-tight chamber; and the single closed liquid-tight chamber is vented to a source of atmospheric pressure through an elongated small diameter venting passageway extending between the single closed liquid-tight chamber within the integral, liquid-tight outer housing and a breather point higher up in the collection tank in which the sewage grinder pump assembly is mounted.

3. A universal sewage grinder pump assembly according to claim 2 wherein the elongated small diameter venting passageway is physically formed within a liquid-tight power supply cable for supplying electric power from an electric power supply junction box mounted high up near a top end of the collection tank to the grinder pump motor via the normal high and low liquid level sensing and control means and the high liquid level alarm sensing and control means.

4. A universal sewage grinder pump assembly according to claim 3 wherein the dynamically operable liquid level safety cutoff means mounted within the liquid level sensing bell means comprises at least one float operated cutoff safety valve located in an interconnecting passageway between the liquid level sensing diving bell means and the normal high and low and alarm high liquid level sensing and control means for cutting off leakage of liquid into said sensing and control means via the level sensing diving bell means in the event that the liquid level in the interconnecting passageway rises above a predetermined threshold level.

5. A universal sewage grinder pump assembly according to claim 4 wherein a venting passageway safety stop valve means is interposed in the small diameter venting passageway at a breather point well up near the top of a collection tank in which the grinder pump assembly is mounted close to where the venting tube is vented to a source of atmospheric pressure gas.

6. A universal sewage grinder pump assembly according to claim 1 wherein the electric motor driving the grinder pump is a submersible electric motor having its own liquid-tight container.

7. A universal sewage grinder pump assembly according to claim 1 wherein the pump is a progressive cavity-type, semi-positive displacement pump.

8. A universal sewage grinder pump assembly according to claim 1 wherein the electric motor driving the grinder pump is a submersible electric motor having its own liquid-tight container, and the pump is a progressive cavity-type positive displacement pump.

9. A universal sewage grinder pump assembly according to claim 8 wherein the grinder pump has an integrally formed anti-siphon valve and an integrally formed output check valve mounted on the discharge end thereof.

10. A universal sewage grinder pump assembly according to claim 9 wherein the sewage grinder pump has a discharge outlet coupled through an adaptable length discharge conduit sized to provide a liquid-tight high pressure connection from the discharge outlet of the grinder pump through a suitable coupling mounted on the side of the collection tank to a pressure sewage disposing piping system exterior of the collection tank.

11. A universal sewage grinder pump assembly according to claim 10 wherein adaptable discharge conduit is fabricated from flexible material and the coupling is mounted on the side of the collection tank comprises at least a two-part, quick connect-disconnect slide coupling which allows ready installation and removal for repair or replacement of the grinder pump using a remotely operated tool from the surface of the earth above and around the collection tank to quickly and easily slide couple or slide decouple the adaptable discharge conduit to or from a sewage disposing piping system.

12. A universal sewage grinder pump assembly according to claim 11 further including a support stand for holding the integral liquid-tight housing containing the electric motor driven grinder pump upright in a balanced stable position within the collection tank and with the open intake end of the grinder pump properly spaced relative to the bottom of the collection tank to assure scouring of the bottom during operation of the grinder pump to thereby prevent buildup of solids on the bottom.

13. A universal sewage grinder assembly according to claim 10 wherein the adaptable discharge conduit is fabricated from solid inflexible material such as stainless steel piping having a slide coupling therein for adjusting the length of the adaptable length discharge conduit to fit a particular pre-installed or existing collection tank facility and terminating in a hooked, return bend portion the short end of which slides into a socket on the intake side of a ball-type stop valve, said ball-type stop valve having a rotating handle lever that can be operated from the surface.

14. A universal sewage grinder pump assembly according to claim 13 further including a support stand for holding the integral liquid-tight housing containing the electric motor driven grinder pump upright in a balanced stable position within the collection tank and with the open intake end of the grinder pump properly spaced relative to the bottom of the collection tank to assure scouring of the bottom during operation of the grinder pump to thereby prevent buildup of solids on the bottom.

15. A universal sewage grinder pump assembly according to claim 1 wherein the grinder pump has an integrally formed anti-siphon valve and an integrally formed output check valve mounted on the discharge end thereof.

16. A universal sewage grinder pump assembly according to claim 1 wherein the sewage grinder pump has a discharge outlet coupled through an adaptable length discharge conduit sized to provide a liquid-tight high pressure connection from the discharge outlet of the grinder pump through a suitable coupling mounted on the side of the collection tank to a pressure sewage disposing piping system exterior of the collection tank.

17. A universal sewage grinder pump assembly according to claim 16 wherein adaptable discharge conduit is fabricated from flexible material and the coupling is mounted on the side of the collection tank comprises at least a two-part, quick connect-disconnect slide coupling which allows ready installation and removal for repair or replacement of the grinder pump using a remotely operated tool from the surface of the earth above and around the collection tank to quickly and easily slide couple or slide decouple the adaptable discharge conduit to or from a sewage disposing piping system.

18. A universal sewage grinder assembly according to claim 16 wherein the adaptable discharge conduit is fabricated from solid inflexible material such as stainless steel piping having a slide coupling therein for adjusting the length of the adaptable length discharge conduit to fit a particular pre-installed or existing collection tank facility and terminating in a hooked, return bend portion the short end of which slides into a socket on the intake side of a ball-type stop valve, the ball-type stop valve having a rotating handle lever that can be operated from the surface.

19. A universal sewage grinder pump assembly according to claim 1, further comprising a universal support means for supporting said grinder pump assembly within diverse types of collection tanks.

20. An integral, readily installed, universal sewage grinder pump assembly comprising:

an integral, liquid-tight outer housing for supporting within a single liquid-tight containment vessel an electric motor driven grinder pump wherein the pump has a grinder unit on a suction intake side thereof for shredding and pulverizing liquid sewage collected in a collection tank, and discharging ground sewage from a discharge outlet of the pump at an increased pressure; normal high and normal low liquid level sensing and control means supported within said integral liquid-tight outer housing for deriving on-off switching electric control signals for controlling normal on-off operation of the motor driven pump;

high liquid level alarm sensing and control means supported within said integral outer housing for sensing abnormally high fluid level alarm conditions in the collection tank and deriving an output alarm control signal for redundantly energizing the motor driven pump upon sensing a high liquid level alarm condition in the collection tank and for providing a remote high level alarm indication to an accessible operator location for informing an operator of the assembly of the high level alarm condition;

liquid level sensing diving bell means supported on said integral housing and having at least one lower open end exposed to the liquid in the collection tank for deriving liquid level indicating signals for application to said normal high and normal low liquid level sensing and control means and to said high liquid level alarm sensing and control means; and dynamically operable liquid level safety cutoff valve means mounted within said sensing diving bell means for cutting off access of liquid fluid to said normal high and normal low liquid level sensing and control means and to said high liquid level alarm sensing and control means upon the liquid level in the sensing diving bell means exceeding a predetermined level.

21. A universal sewage grinder pump assembly according to claim 4 wherein the integral outer housing contains a single closed liquid-tight cheer in which both the normal high and low liquid level sensing and control means and the alarm high liquid level sensing and control means are mounted, the liquid level sensing diving bell means derives pressure varying pneumatic, liquid level indicating, signals that are applied to one side only of respective pressure sensitive electric control switches for deriving the normal high and low and the alarm level electric control signals with the remaining sides of the respective pressure sensitive electric control switches being vented to the interior of the single closed liquid-tight chamber; and the single closed liquid-tight chamber is vented to a source of atmospheric pressure through an elongated small diameter venting passageway extending between the single closed liquid-tight chamber on the integral, liquid-tight outer housing and a breather point higher up in the collection tank in which the sewage grinder pump assembly is mounted.

22. A universal sewage grinder pump assembly according to claim 21 wherein the elongated small diameter venting passageway is physically formed within a liquid-tight power supply cable for supplying electric power from an electric power supply junction box mounted high up near the top of the collection tank to the grinder pump motor via the normal high and low liquid level sensing and control means and the high liquid level alarm sensing and control means.

23. A universal sewage grinder pump assembly according to claim 22 wherein the dynamically operable liquid level safety cutoff means mounted within the liquid level sensing diving bell means comprises at least one float operated cutoff safety valve located in an interconnecting passageway between the liquid level sensing diving bell means and the normal high and low and alarm high liquid level sensing and control means for cutting off leakage of liquid into said sensing and control means via the level sensing diving bell means in the event that the liquid level in the interconnecting passageway rises above a predetermined threshold level.

24. A universal sewage grinder pump assembly according to claim 22 wherein said level sensing diving bell means comprises two separate level sensing diving bells secured to the bottom of the integral liquid-tight housing supporting the grinder pump and extending downwardly therefrom with the lower bottom end of each level sensing diving bell being open and exposed to the flow of liquid thereinto whenever the open end thereof is below the surface of the liquid in the collection tank, one of the level sensing diving bells serving to derive the normal high and normal low, on-off, electric control switching signals for controlling on-off operation of the grinder pump, and the remaining level sensing diving bell serving to derive the high liquid level alarm control signal; and the dynamically operable liquid level safety cutoff valve means comprising individual float operated cutoff safety valves located in the interconnecting passageways from the respective level sensing diving bells to the respective normal high and low liquid level sensing and control means and the high liquid level alarm sensing and control means for cutting off leakage of liquid into the respective sensing and control means via the respective level sensing diving bells in the event of prolonged high liquid levels in excess of alarm high liquid level.

25. A universal sewage grinder pump assembly according to claim 20 wherein said level sensing diving bell means comprises two separate diving bells secured to the bottom of the liquid-tight integral housing supporting the grinder pump and extending downwardly therefrom with the lower bottom end of each level sensing diving bell being open and exposed to the flow of liquid thereinto whenever the open end thereof is below the surface of the liquid in the collection tank, one of the level sensing diving bells serving to derive the normal high and normal low on-off control switching signals for controlling on-off operation of the grinder pump, and the remaining level sensing diving bell serving to derive the high liquid level alarm control signal; and the dynamically operable liquid level safety cutoff valve means comprises individual, float operated, cutoff safety valves located in the interconnecting passageways from the respective level sensing diving bells to the respective normal high and low liquid level sensing and control means and the high liquid level alarm sensing and control means for cutting off leakage of liquid into the respective sensing and control means via the respective level sensing diving bells in the event that the liquid level in the interconnecting passageway rises above a predetermined threshold level.

26. A universal sewage grinder pump assembly according to claim 4 further including a support stand for holding the integral liquid-tight housing containing the electric motor driven grinder pump upright in a balanced stable position within the collection tank and with the open intake end of the grinder pump properly spaced relative to the bottom of the collection tank to assure scouring of the bottom during operation of the grinder pump to thereby prevent buildup of solids on the bottom.

27. An integral, readily installed, pump assembly comprising:

an integral, liquid-tight outer housing for supporting within a single liquid-tight containment vessel an electric motor driven pump wherein the pump has a suction intake side thereof immersed in liquid collected in a collection tank, for pumping and discharging the liquid from a discharge outlet of the pump at an increased pressure;

at least one normal high and low liquid level sensing and control pneumatic pressure operated electric switch means supported within said integral liquid-tight outer housing for deriving on-off switching electric control signals for controlling normal on-off operation of the electric motor driven pump;

liquid level sensing diving bell means supported on said integral housing and having at least one lower open end exposed to the liquid in the collection tank for deriving varying pressure pneumatic liquid level indicating signals for application to at least said normal high and low liquid level sensing and control pneumatic pressure operated electric switch for deriving on-off electric control signals applied to said pump motor; and dynamically operated liquid level safety cutoff valve means mounted within said sensing diving bell means for cutting off access of liquid fluid to said normal high and normal low liquid level sensing and control pneumatic pressure operated electric switch means upon the liquid level in the sensing diving bell means exceeding a predetermined level.

28. A pump assembly according to claim 27 wherein the integral liquid-tight outer housing contains a single, closed, liquid-tight chamber in which the normal high and low liquid level sensing and control pneumatic pressure operated electric switch means is mounted and the varying pressure pneumatic liquid level indicating signals derived by the liquid level sensing diving bell means are applied to one side only of the pressure operated electric control switch means for deriving the normal high and low on-off electric control signals with the remaining side of the respective pressure operated electric control switch means being vented to the interior of the single closed liquid-tight chamber;

the single closed liquid-tight chamber being vented to a source of atmospheric pressure gas through an elongated small diameter venting passageway extending between the single closed liquid-tight chamber in the integral, liquid-tight outer housing and a breather point high up in the collection tank in which the pump assembly is mounted; and the elongated small diameter venting passageway being physically supported within a liquid-tight power supply cable for supplying electric power from an electric power supply junction box mounted high up near the top of the collection tank to the pump motor via the normal high and low liquid level sensing and control electric switch means.

29. A pump assembly according to claim 28 wherein the dynamically operated liquid level safety cutoff means mounted within the liquid level sensing diving bell means comprises at least one float operated cutoff safety valve located in an interconnecting passageway between the liquid level sensing diving bell means and the normal high and low liquid level sensing and control electric switch means for preventing leakage of liquid into said sensing and control electric switch means via the sensing diving bell means in the event that the liquid level in the interconnecting passageway rises above a predetermined threshold level.

30. A pump assembly according to claim 29 wherein a venting passageway, float operated safety stop valve is interposed in the small diameter venting tube at a breather point above the pump and above the alarm high liquid level.

31. A pump assembly according to claim 30 wherein said liquid level sensing diving bell means comprises:

two separate level sensing diving bells secured to the bottom of the integral liquid-tight housing supporting the pump and extending downwardly therefrom with the lower bottom end of each level sensing diving bell being open and exposed to the flow of liquid thereinto whenever the open end of either diving bell is below the surface of the liquid in the collection tank, one of the level sensing diving bells serving to derive the normal high and normal low, on-off electric control switching signals for controlling on-off operation of the pump, and the remaining level sensing diving bell serving to derive a high liquid level alarm signal that is supplied to one side of a second pneumatic pressure actuated electric switch also mounted in the closed liquid-tight chamber with the second side of the second pressure actuated electric switch vented to the interior of the chamber; and dynamically operated liquid level safety cutoff valve means comprising individual float operated cutoff safety valves located in the interconnecting passageways from the respective level sensing diving bells to the respective normal high and low liquid level sensing and control pressure operated electric switch and the high liquid level alarm sensing pressure operated electric switch for preventing leakage of liquid into the respective sensing and control switches via the respective level sensing diving bells in the event of prolonged high liquid levels in excess of alarm high liquid level.

32. A pump assembly according to claim 31 wherein the electric motor driving the pump is a submersible electric motor having its own liquid-tight housing and the pump is a progressing cavity- type semi-positive displacement pump.

33. A pump assembly according to claim 32 wherein the pump has an integrally formed anti-siphon valve and an integrally formed output check valve mounted on the discharge end thereof.

34. A pump assembly according to claim 33 wherein the discharge outlet of the sewage pump is coupled through an adaptable discharge conduit of sufficient and adjustable length to provide a liquid-tight high pressure connection from the discharge outlet of the pump through a suitable quick connect-disconnect coupling mounted on the side of the collection tank to a liquid disposing piping system exterior of the collection tank.

* * * * *

UNITED STATES PATENT AND TRADEMARK OFFICE

CERTIFICATE OF CORRECTION

PATENT NO. : 5,439,180

DATED : August 8, 1995

INVENTOR(S) : Henry, et al.

It is certified that error appears in the above-indentified patent and that said Letters Patent is hereby corrected as shown below: On the title page:

Item: [75], the order of the inventors should read --

Clark A. Henry, Scotia;
Andrew P. Sleasman, Gansevoort;
William R. Schouten, Castleton;
Gene A. Rougeux, Boiceville;
Thomas R. Baughman, Clifton Park, all of NY Column 19:

In claim 21, line 64 "claim 4" should read "claim 20",
on line 65 "cheer" should read "chamber".

In claim 26, line 25 "claim 4" should read "claim 20".

Signed and Sealed this

Twenty-eighth Day of November 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,439,180

DATED : August 8, 1995

INVENTOR(S) : Henry, et al.

It is certified that error appears in the above-indentified patent and that said Letters Patent is hereby corrected as shown below:

Title page, item [19] "Baughman et al." should read —Henry et al.—

Signed and Sealed this

Twenty-third Day of January, 1996

*Attest:*

Bruce Lehman

BRUCE LEHMAN

*Attesting Officer*

*Commissioner of Patents and Trademarks*